US009644394B2

(12) United States Patent
Breimayer et al.

(10) Patent No.: US 9,644,394 B2
(45) Date of Patent: May 9, 2017

(54) DOOR HANDLE ASSEMBLY, SUB-ASSEMBLY AND METHOD OF INSTALLING SAME

(75) Inventors: Dennis Breimayer, Lowell, MI (US); Andrew Fouchea, Cedar Springs, MI (US); Jeffrey Stokes, Milan, MI (US)

(73) Assignee: ADAC PLASTICS, INC., Grand Rapids, MI (US)

( * ) Notice: Subject to any disclaimer, the term of this patent is extended or adjusted under 35 U.S.C. 154(b) by 604 days.

(21) Appl. No.: 14/127,755

(22) PCT Filed: Jun. 20, 2012

(86) PCT No.: PCT/US2012/043394

§ 371 (c)(1),
(2), (4) Date: May 13, 2014

(87) PCT Pub. No.: WO2013/109306

PCT Pub. Date: Jul. 25, 2013

(65) Prior Publication Data

US 2014/0245568 A1 Sep. 4, 2014

Related U.S. Application Data

(60) Provisional application No. 61/498,789, filed on Jun. 20, 2011.

(51) Int. Cl.
*E05B 3/00* (2006.01)
*E05B 7/00* (2006.01)
(Continued)

(52) U.S. Cl.
CPC ..... *E05B 7/00* (2013.01); *E05B 79/06* (2013.01); *E05B 85/10* (2013.01); *E05B 85/16* (2013.01);
(Continued)

(58) Field of Classification Search
CPC ..... E05B 85/10; E05B 7/00; Y10S 292/60
(Continued)

(56) References Cited

U.S. PATENT DOCUMENTS 6,234,548 B1 * 5/2001 Mittelbach ..... E05B 79/06 292/336.3
6,401,302 B1 * 6/2002 Josserand ..... E05B 79/06 16/444
(Continued)

FOREIGN PATENT DOCUMENTS

DE 10146026 C1 * 10/2002 ..... E05B 79/06
EP 1026347 8/2009
(Continued)

OTHER PUBLICATIONS

International Search Report, Aug. 12, 2013, for PCT/US2012/043394.

*Primary Examiner* — Carlos Lugo
(74) *Attorney, Agent, or Firm* — Dickinson Wright PLLC

(57) ABSTRACT

A vehicle door handle assembly, comprising: a door handle having opposite first and second ends, the first end including a handle leg connectable to a bellcrank; a door handle end-cap; a slide-lock cassette supporting the bellcrank; and a frame mounting the door handle and the door handle end-cap. The frame is securable to a vehicle door and defines an opening receiving the slide-lock cassette therein. The opening is dimensioned to permit sliding movement of the slide-lock cassette therein. The slide-lock cassette is slidingly moveable relative to the frame between a first position, in which the handle leg is not connected to the bellcrank and the door handle end cap is not secured in place relative to the frame, and a second position, in which the handle leg is connected to the bellcrank and the door handle end-cap is captured by the slide-lock cassette against removal from the frame.

24 Claims, 4 Drawing Sheets

(51) Int. Cl.
*E05B 85/10* (2014.01)
*E05B 79/06* (2014.01)
*E05B 85/16* (2014.01)
*E05B 1/00* (2006.01)

(52) U.S. Cl.
CPC ..... *Y10S 292/60* (2013.01); *Y10T 16/44* (2015.01); *Y10T 29/49826* (2015.01); *Y10T 29/49963* (2015.01)

(58) Field of Classification Search
USPC ..... 292/336.3
See application file for complete search history.

(56) References Cited

U.S. PATENT DOCUMENTS 6,523,871 B1 * 2/2003 Josserand ..... E05B 79/06 292/347
6,612,630 B1 * 9/2003 Meinke ..... E05B 79/06 292/336.3
6,749,236 B2 * 6/2004 Nomura ..... E05B 85/16 16/412
6,834,901 B2 * 12/2004 Low ..... E05B 79/06 16/412
7,029,042 B2 * 4/2006 Belchine, III ..... E05B 77/06 292/230
7,080,532 B2 * 7/2006 Bucker ..... E05B 79/06 292/336.3
7,146,832 B2 * 12/2006 Mathofer ..... E05B 79/06 292/336.3
7,260,964 B2 * 8/2007 Velicanin ..... E05B 79/06 292/336.3
7,556,296 B2 * 7/2009 Kondo ..... E05B 85/16 292/336.3
8,157,301 B2 * 4/2012 Sunahara ..... E05B 85/16 292/336.3
8,746,758 B2 * 6/2014 Savant ..... E05B 77/06 292/336.3
8,998,277 B2 * 4/2015 Jeong ..... E05B 85/10 292/336.3
2005/0093306 A1 5/2005 Pudney
2007/0069533 A1 3/2007 Cummins et al.
2007/0158960 A1 7/2007 Tanimoto et al.
2007/0294861 A1 12/2007 Cummins et al.
2012/0080892 A1 * 4/2012 Nagata ..... E05B 85/16 292/336.3
2015/0061304 A1 * 3/2015 Ichikawa ..... E05B 85/16 292/336.3

FOREIGN PATENT DOCUMENTS

FR EP 1026347 A1 * 8/2000 ..... E05B 79/06
JP 2000-225844 A 8/2000
JP 2003-193706 A 7/2003
KR 20-0391688 8/2005
MC FR 2910515 A1 * 6/2008 ..... E05B 79/06
WO WO2005042883 5/2005

* cited by examiner

DOOR HANDLE ASSEMBLY, SUB-ASSEMBLY AND METHOD OF INSTALLING SAME

CROSS-REFERENCE TO RELATED APPLICATIONS

The present application is a 35 U.S.C. Section 371 national stage filing of International Patent Application No. PCT/US2012/043394, filed 20 Jun. 2012, and through which priority is claimed to U.S. Provisional Application 61/498,789, filed 20 Jun. 2011, the disclosures of which are incorporated herein by reference in their entireties.

FIELD OF THE INVENTION

The present disclosure relates generally to door handle assemblies, sub-assemblies, and methods of their installation.

BACKGROUND

Typically, chassis-style vehicle door handles are assembled to the vehicle by inserting a handle strap and then sliding it aft to bring the handle into connection with other handle components such as the bell crank, etc. This requires concessions on the size of the handle, the size of openings in the sheet metal of the vehicle door, the sealing of those holes, and it requires that the handle bezel be a separate fitted piece of the handle assembly.

SUMMARY

The present disclosure comprehends a vehicle door handle assembly, comprising: (a) A door handle having opposite first and second ends, the first end including a handle leg connectable to a bellcrank; (b) a door handle end-cap; (c) a slide-lock cassette supporting the bellcrank; and (d) a frame mounting the door handle and the door handle end-cap. The frame is securable to a vehicle door, and defines an opening receiving the slide-lock cassette therein, the opening dimensioned to permit sliding movement of the slide-lock cassette therein. The slide-lock cassette is slidingly moveable relative to the frame between a first position, in which the handle leg is not connected to the bellcrank and the door handle end cap is not secured in place relative to the frame, and a second position, in which the handle leg is connected to the bellcrank and the door handle end-cap is captured by the slide-lock cassette against removal from the frame.

The present disclosure further comprehends a method of installing a vehicle door handle assembly, comprising the steps of: Providing a door handle having opposite first and second ends, the first end including a handle leg connectable to a bellcrank; providing a door handle end-cap; providing a slide-lock cassette supporting the bellcrank; providing a frame for mounting the door handle and the door handle end-cap, the frame securable to a vehicle door, and the frame defining an opening receiving the slide-lock cassette therein, the opening dimensioned to permit sliding movement of the slide-lock cassette therein between a first position, in which the handle leg is not connected to the bellcrank and the door handle end-cap is not secured in place relative to the frame, and a second position, in which the handle leg is connected to the bellcrank and the door handle end-cap is captured by the slide-lock cassette against removal from the frame; inserting the slide-lock cassette in the opening defined in the frame; mounting the door handle and end-cap on the frame; and slidingly moving the slide-lock cassette from the first position to the second position, thereby connecting the handle leg to the bellcrank and the capturing the door handle end-cap by the slide-lock cassette against removal from the frame.

The present disclosure further comprehends a sub-assembly for a vehicle door handle assembly including a door handle having opposite first and second ends, the first end including a handle leg, and a door handle end-cap. The sub-assembly comprises a slide-lock cassette supporting a bellcrank connectable to the handle leg of the handle, and a frame securable to a vehicle door. The frame mounts the door handle and the door handle end-cap, and defines an opening receiving the slide-lock cassette therein, the opening dimensioned to permit sliding movement of the slide-lock cassette therein. The slide-lock cassette is slidingly moveable relative to the frame between a first position, in which the handle leg is not connected to the bellcrank and the door handle end cap is not secured in place relative to the frame, and a second position, in which the handle leg is connected to the bellcrank and the door handle end-cap is captured by the slide-lock cassette against removal from the frame.

According to each of the assembly, sub-assembly and method, one feature of the present invention comprehends a mounting feature engageable with the slide-lock cassette and selectively adjustable to effect sliding movement of the slide-lock cassette relative to the frame between the first and second positions. The mounting feature may, per one exemplary embodiment, comprise a screw disposed in an opening in the frame for rotational movement relative thereto. The screw is threadingly engaged with the slide-lock cassette so that rotational movement of the screw moves the slide-lock cassette relative to the screw, thereby effecting sliding movement of the slide-lock cassette relative to the frame between the first and second positions.

Also according to each of the assembly, sub-assembly and method, per another feature the frame includes one or more projections extending into the slide-lock cassette-receiving opening, the one or more projections confronting one or more surfaces of the slide-lock cassette to slidably capture the slide-lock cassette within the slide-lock cassette-receiving opening. In one exemplary form, the frame defines an end-cap receiving opening, and the one or more projections include at least one shelf portion defined about the perimeter of the slide-lock cassette-receiving opening, and at least one tab extending away from the end-cap receiving opening.

Also according to each of the assembly, sub-assembly and method, per another feature the frame defines an end-cap receiving opening; the end-cap includes at least one retaining lip extending radially therefrom; and the slide-lock cassette includes an opening receiving a portion of the frame defining the end-cap receiving opening, and at least one retaining lip extending into the opening. In the second position of the slide-lock cassette, the at least one retaining lip of the slide-lock cassette is positioned in the end-cap receiving opening so as to oppose the at least one retaining lip of the end-cap to thereby capture the end-cap against removal from the frame.

Per another feature of each of the assembly, sub-assembly and method, the handle leg is connected to engagement flanges provided on the bellcrank in the second position of the slide-lock cassette.

Per still another feature of each of the assembly, sub-assembly and method, the slide-lock cassette supports an inertia lock.

Other features and advantages of the present disclosure will be readily appreciated, as the same becomes better understood after reading the subsequent description taken in conjunction with the accompanying drawings.

It is to be understood that the drawings are not necessarily to scale.

DESCRIPTION

The present disclosure comprehends a door handle assembly for a vehicle door, a sub-assembly of such a door handle assembly, as well as a method of installing the same. More particularly, the present invention comprehends a vehicle door handle assembly, comprising: (a) a door handle having opposite first and second ends, the first end including a handle leg connectable to a bellcrank; (b) a door handle end-cap; (c) a slide-lock cassette supporting the bellcrank; and (d) a frame mounting the door handle and the door handle end-cap. The frame is securable to a vehicle door, and defines an opening receiving the slide-lock cassette therein, the opening dimensioned to permit sliding movement of the slide-lock cassette therein. The slide-lock cassette is slidingly moveable relative to the frame between a first position, in which the handle leg is not connected to the bellcrank and the door handle end cap is not secured in place relative to the frame, and a second position, in which the handle leg is connected to the bellcrank and the door handle end-cap is captured by the slide-lock cassette against removal from the frame.

According to the method of installing a vehicle door handle assembly according to the present invention, there are generally comprehended the steps of: Providing a door handle having opposite first and second ends, the first end including a handle leg connectable to a bellcrank; providing a door handle end-cap; providing a slide-lock cassette supporting the bellcrank; providing a frame for mounting the door handle and the door handle end-cap, the frame securable to a vehicle door, and the frame defining an opening receiving the slide-lock cassette therein, the opening dimensioned to permit sliding movement of the slide-lock cassette therein between a first position, in which the handle leg is not connected to the bellcrank and the door handle end-cap is not secured in place relative to the frame, and a second position, in which the handle leg is connected to the bellcrank and the door handle end-cap is captured by the slide-lock cassette against removal from the frame; inserting the slide-lock cassette in the opening defined in the frame; mounting the door handle and end-cap on the frame; and slidingly moving the slide-lock cassette from the first position to the second position, thereby connecting the handle leg to the bellcrank and the capturing the door handle end-cap by the slide-lock cassette against removal from the frame.

Figure 1:
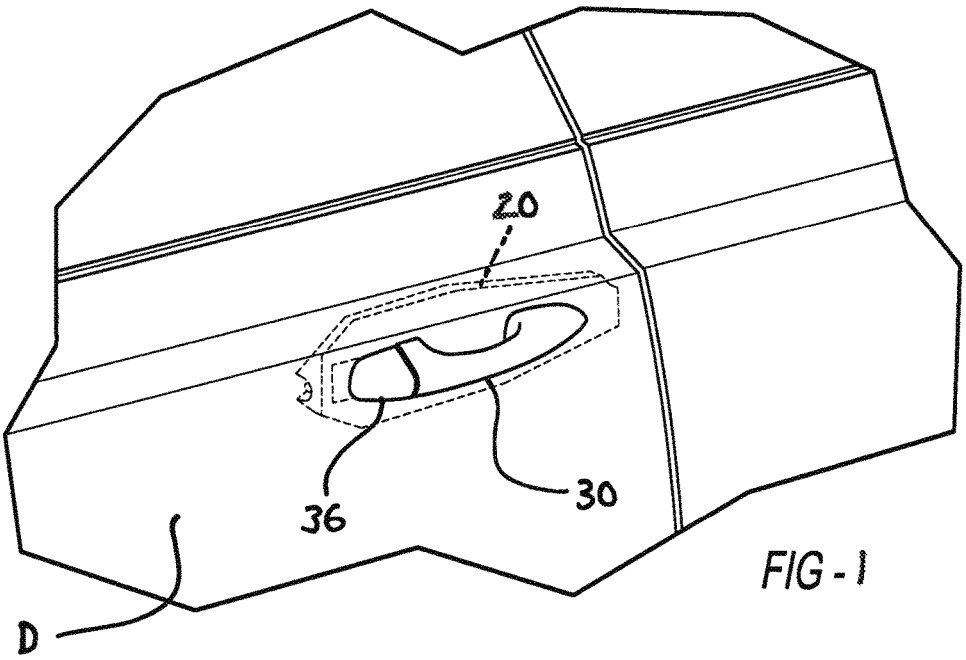
FIG. 1 is a detailed perspective view of a portion of a vehicle door mounting a door handle assembly according to an exemplary embodiment of the present invention.
Figure 2:
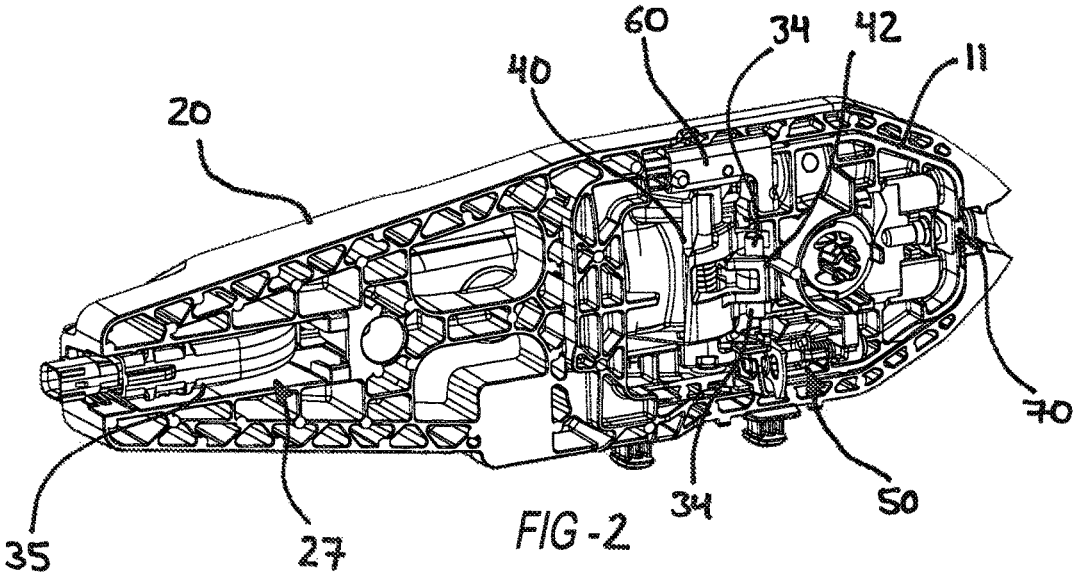
FIG. 2 illustrates an interior side view (relative to the vehicle in which it is mounted) of a door handle assembly according to an exemplary embodiment of the present invention.
Figure 3:
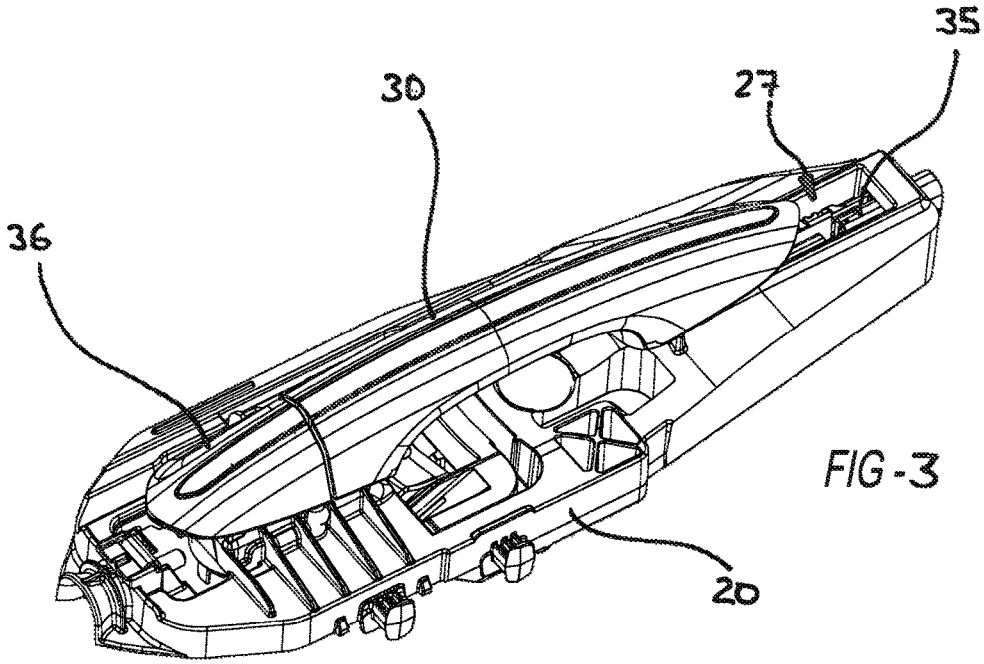
FIG. 3 illustrates an exterior side view (relative to the vehicle in which it is mounted) of the door handle assembly of FIG. 2.
Figure 5:
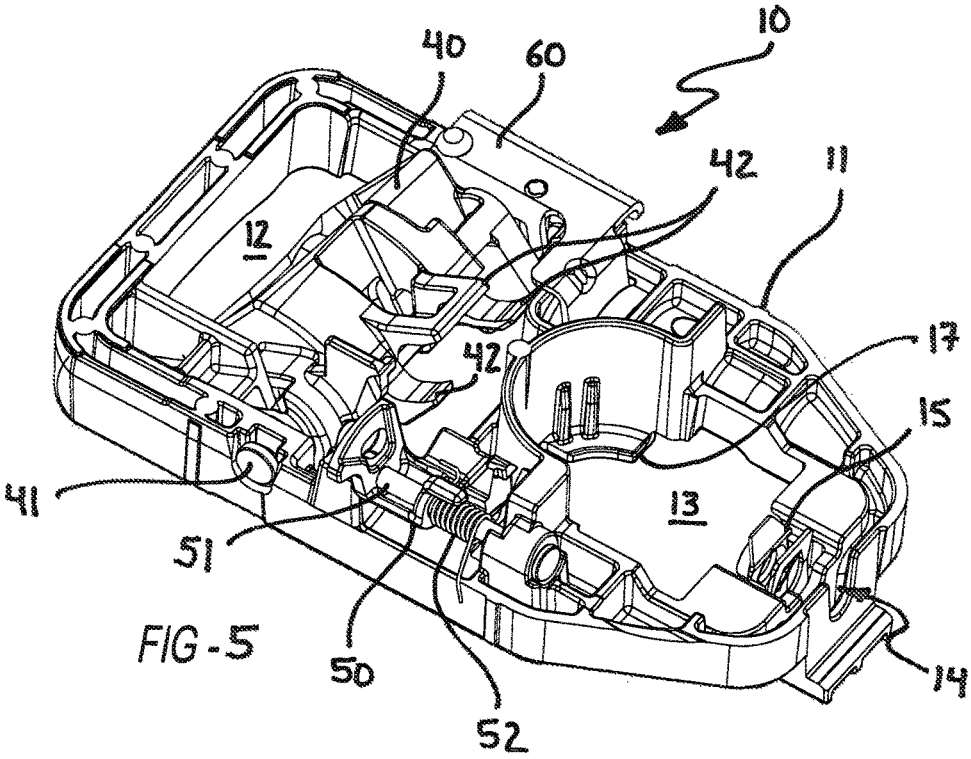
FIG. 5 is a perspective view of the slide-lock cassette portion of the door handle assembly of FIG. 2.
Figure 4:
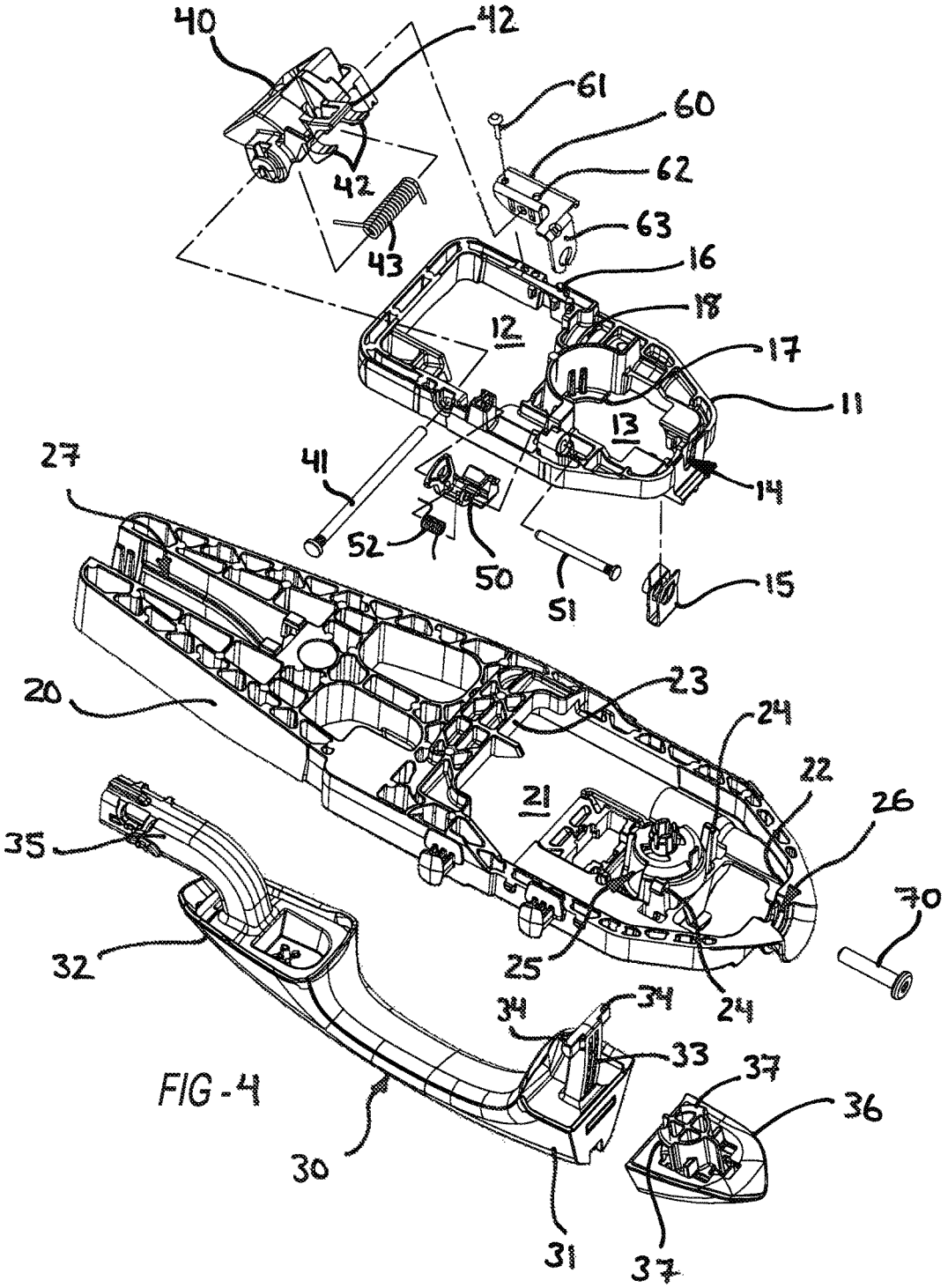
FIG. 4 is an exploded perspective view of the door handle assembly of the present invention according to the exemplary embodiment of FIG. 2, taken from the interior (relative to the vehicle in which it is mounted) side of the door handle assembly.

Referring now to FIGS. 1-7, in which like or corresponding numbers represent like or corresponding parts, the present invention is still more particularly described in relation to the exemplary embodiment thereof. As shown, a slide-lock cassette 10, sometimes also referred to as a carrier or module, is adjustably mounted to a frame 20 that is, in turn, mountable to the door D of a vehicle (FIG. 1). A movable door handle (shown generally at 30) and stationary, door handle end-cap 36 are mounted to an exterior side (the exposed face in FIG. 3) of frame 20 through openings defined in frame 20. Slide-lock cassette 10 is adjustable in the manner hereafter described to secure the door handle 30 and end cap 36 to the frame 20.

Handle 30 can take the form of any conventional style of vehicle door handle, subject to modification to the present invention (which will be apparent to those skilled in the art from this disclosure) to achieve the advantages thereof as described herein. In the exemplary embodiment, handle 30 is a "strap"-style handle, the principal length of which spans a gap formed to provide suitable clearance for receiving a user's hand. Handle 30 includes first 31 and second 32 ends. First end 31 includes a handle leg 33 extending therefrom, the handle leg 33 terminating in projections 34 extending outwardly away from the leg 33. Second end 32 includes a mounting extension 35 which may, per convention, define a passageway for electronic cabling coupling electronics in the handle with electronics in the vehicle. Per convention, handle 30 is pivotally movable relative to the frame 20 proximate the second end 32 thereof, such that the first end 31 may be pulled away from the door by a user in order to actuate the door latch (to which the handle is connected, via bellcrank 40, in conventional fashion).

Door handle end-cap 36 may optionally house a locking core for unlocking the vehicle with a key.

Slide-lock cassette 10 is mounted within a front opening 21 on an interior side (the exposed face in FIG. 2) of frame 20. Slide-lock cassette 10 is a module including at least one moving part, such as a bellcrank 40, associated with operation of the door handle 20, each such moving part engaging the appropriate features of door handle 30 to provide opening/closing and locking/unlocking functionality of a vehicle door, per convention.

Slide-lock cassette 10 includes a body 11 defining one or more openings. In this example, body 11 forms each of a bellcrank opening 12, an end-cap opening 13, and an installation opening 14. Installation opening 14 can be threaded to receive a mounting feature, such as a threaded bolt or screw, or a threaded nut or other threaded element can be provided to threadingly connect the cassette and mounting feature. In the illustrated embodiment, a bracket 15 is mountable on the body 11 proximate opening 14, the bracket 15 adapted to threadingly receive the mounting feature.

Body 11 can be constructed of any suitable material including, but not limited to, metal or plastic.

Bellcrank 40 is mounted within opening 12 of body 11. To that end, opening 12 is sized and shaped to receive bellcrank 40 and at least handle leg 33, as well as to provide space for movement and rotation of bellcrank 40 when handle 30 is actuated to open the vehicle door. Bellcrank 40 is rotatably fixed to oppositely-positioned frame members of body 11 by one or more pivot pins 41. Engagement flanges 42 protrude outwardly from bellcrank 40 and extend into opening 12 to engage the projections 34 of handle leg 33 as discussed below. Per convention, flanges 42 are constructed and arranged to provide a leveraging force against bellcrank 40, and thereby facilitate opening of the vehicle door when the handle 30 is actuated by a user. Also per convention, one or more internal springs 43 are provided to return bellcrank 40 to its default position after bellcrank 40 is rotated during actuation of handle 30.

In the exemplary embodiment, an inertia lock 50 may also be rotatably mounted on body 11. Inertia lock 50 is adapted, per convention, to engage bellcrank 40 in the event of an acceleration force occasioned by an impact event to thereby prevent the vehicle door from opening unintentionally. Inertia lock 50 is mounted to cassette body 11 by one or more pivot pins 51. Per convention, one or more springs 52 are provided to return inertia lock 50 to its default position (i.e., in which the inertia lock 50 is disengaged from the bellcrank 40).

Figure 6:
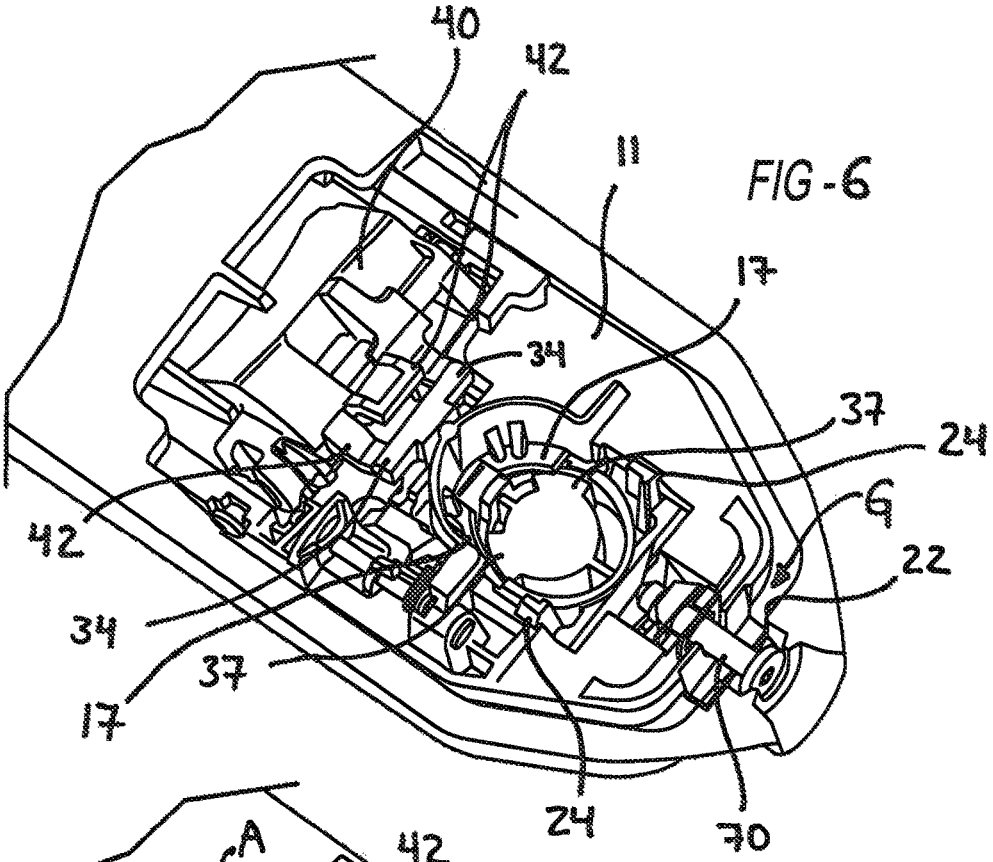
FIG. 6 is a simplified view of the door handle assembly of the present invention, with the cassette depicted in the first position relative to the frame, in which first position the handle leg is not connected to the bellcrank and the door handle end cap is not secured in place relative to the frame.
Figure 7:
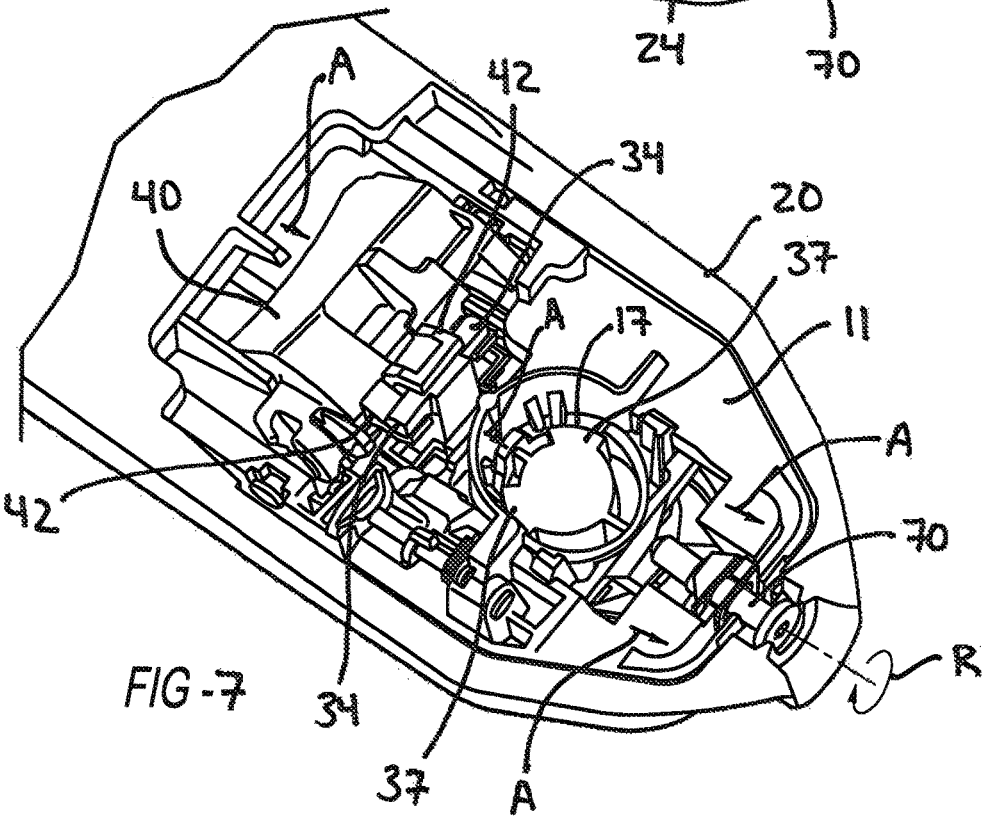
FIG. 7 is a simplified view of the door handle assembly of the present invention, with the cassette depicted in the second position relative to the frame, in which second position the handle leg is connected to the bellcrank and the door handle end-cap is captured by the slide-lock cassette against removal from the frame.

FIGS. 6 and 7 illustrate assembly of slide-lock cassette 10 with handle 30 onto frame 20. Body 11 of slide-lock cassette 10 is sized and shaped to adjustably fit into the opening 21 of frame 20 into an aft position, shown in FIG. 7, thereby defining an adjustment gap G between the body 11 and forward frame wall 22. Slide-lock cassette body 11 is slidably captured in frame 20 by means of a shelf portion 23 which extends over a portion of opening 22, as well as by tabs 24 positioned near end-cap opening 25 on frame 20. Tabs 24 extend outwardly away from the opening 25 and are engagable over flat surfaces of the body 11, all as best shown in FIGS. 6 and 7. As will be appreciated from the drawings, tabs 24 are part of resiliently deformable structures so as to be capable of being urged inwardly as cassette 10 is placed into the opening 21, and returning to their original shape (with the tabs 24 engaging upper surfaces of the cassette 10) after the cassette 10 is fully received in the opening 21.

As noted, a mounting feature 70 is inserted through installation opening 14. Mounting feature 70 can be any securing feature that securely mounts slide-lock cassette 10 to frame 20. In the illustrated example, mounting feature 70 is a threaded screw or bolt threadingly connectable with the installation opening 14 (such as via the bracket 15, described above). In this example, mounting feature 70 is a shut-face screw having a head portion which is rotatably captured in a correspondingly-shaped slot 26 defined in frame 20 and axially aligned with the installation opening 14. By this arrangement, it will be appreciated that mounting feature 70 is axially fixed while remaining rotatable, thereby facilitating axial movement of the cassette 10 upon rotational movement of the mounting feature 70. Accordingly, turning mounting feature 70 in a tightening direction (indicated by the arrow R in FIG. 7) causes a positional adjustment or an axial translation of cassette 10, thereby at least partially closing adjustment gap G. As shown in FIG. 7, mounting feature 70 has adjusted slide-lock cassette 10 in the direction of arrows A to a forward position such that frame wall 22 and body 11 are proximately close or flush with respect to each other.

In assembly, cassette 10 is placed within the opening 21 in frame 20, such that the cassette is held in place by the tabs 24 and shelf 23 described hereabove. In this configuration, cassette is positioned rearwardly to leave an adjustment gap between the forward end of the cassette 10 and the end wall 22 of frame 20. In this first position, the handle 30 and end-cap 36 are freely mountable.

Handle 30 is positioned to insert mounting extension 35 through opening 27 in frame 20 and handle leg 33 through both opening 21 and opening 12 proximate bellcrank 40. As shown best in FIG. 2, mounting extension 33 lies substantially flush against the interior side of frame 20. Handle leg 33 extends inwardly from front end 32 through bellcrank opening 12.

End-cap 36 is mounted to the frame 20 through opening 25 in frame 20 and opening 13 in cassette body 11, via a stem or post portion which extends into openings 25 and 13. End cap 36 defines at least one radially-extending retaining lip 37 that abuts a corresponding frame retaining lip 17 formed on body 11 and extending into opening 13 (both such lips 17, which are spaced apart within the opening 13, are visible in FIGS. 6 and 7).

Referring to FIG. 7, the slide-lock cassette 10 is shown in the second position thereof relative to the frame 20, thus connecting handle 30 to bellcrank 40 and capturing end-cap 36. To achieve this second position, mounting feature 70 is rotated in a direction which moves cassette 10 axially forward within opening 21 by the threading interrelationship of the mounting feature 70 and bracket 15, thereby bringing bellcrank engagement flanges 42 into engagement with handle leg projections 34. Simultaneously, frame-retaining lips 13 are brought into a position where they are disposed between frame 20 and end-cap retaining lips 37. Accordingly, handle 30 is securely mounted to frame 20 through cassette 10.

Further, and as will be appreciated from the foregoing, the moving parts, i.e., bellcrank 40, inertia lock 50, etc., are correspondingly brought into their proper respective positions relative to the handle 30 by the sliding adjustment of cassette 10 relative to frame 20.

To further secure the cassette 10 relative to the frame 20, a bracket 60 may also be fixed, such as via one or more screws 61 or other fastening means, to slide-lock cassette body 11. Bracket 60 is dimensioned to extend over a portion of frame 20 (see FIGS. 6 and 7) in order to prevent cassette 10 from being separated from the frame 20. Furthermore, bracket 60 includes a portion 63 received through an opening 18 in the cassette body 11 and confronting a surface of the frame 20 to prevent further sliding movement of the cassette 10 relative to frame 20. As shown, bracket 60 also optionally includes one or more openings 62 which each receive a projecting feature 16 of the cassette 10, thereby preventing unwanted rotational movement of the cassette 10 relative to frame 20. Bracket 60 may be fashioned from metal, plastic or other suitable material.

By assembling all of the moving parts of the slide-lock cassette onto one piece, the manufacturing tolerances can be improved. And by not requiring that the handle be slid aft during assembly, the size of the handle may be reduced, the size of the sheet metal holes through the vehicle door panel may be reduced, the seals around the sheet metal holes can be made more robust and therefore sealing is improved, clearance between the handle and the frame can be reduced and therefore, handle wobble can be improved. Further, there is no longer the need to have a separate handle bezel since the handle does not have to be slid aft during installation.

Many modifications and variations of the present disclosure are possible in light of the above teachings. For example, and without limitation, those skilled in the art will appreciate, with the benefit of this disclosure, that the advantages of the present invention as described hereinabove may be achieved with various modifications to the specific configuration of the assembly of the exemplary embodiment. Therefore, within the scope of the appended claims, the present disclosure may be practiced other than as specifically described.

The invention in which an exclusive property or privilege is claimed is defined as follows:

1. A vehicle door handle assembly, comprising:

(a) a door handle having opposite first and second ends, the first end including a handle leg connectable to a bellcrank;

(b) a door handle end-cap;

(c) a slide-lock cassette supporting the bellcrank; and (d) a frame mounting the door handle and the door handle end-cap, the frame securable to a vehicle door, and the frame defining an opening receiving the slide-lock cassette therein, the opening dimensioned to permit sliding movement of the slide-lock cassette therein;

wherein the slide-lock cassette is, by the application of force thereto, slidingly moveable relative to the frame between a first position, in which the handle leg is not connected to the bellcrank and the door handle end cap is not secured in place relative to the frame, and a second position, in which the handle leg is connected to the bell crank and the door handle end-cap is captured by the slide-lock cassette against removal from the frame.

2. The vehicle door handle assembly of claim 1, further comprising a mounting feature engageable with the slide-lock cassette and selectively adjustable to effect sliding movement of the slide-lock cassette relative to the frame between the first and second positions.

3. The vehicle door handle assembly of claim 2, wherein the mounting feature comprises a screw disposed in an opening in the frame for rotational movement relative thereto, the screw threadingly engaged with the slide-lock cassette so that rotational movement of the screw moves the slide-lock cassette relative to the screw, thereby effecting sliding movement of the slide-lock cassette relative to the frame between the first and second positions.

4. The vehicle door handle assembly of claim 1, wherein the frame includes one or more projections extending into the slide-lock cassette-receiving opening, the one or more projections confronting one or more surfaces of the slide-lock cassette to slidably capture the slide-lock cassette within the slide-lock cassette-receiving opening.

5. The vehicle door handle assembly of claim 4, wherein the frame defines an end-cap receiving opening, and the one or more projections include at least one shelf portion defined about the perimeter of the slide-lock cassette-receiving opening, and at least one tab extending away from the end-cap receiving opening.

6. The vehicle door handle assembly of claim 1, wherein further: the frame defines an end-cap receiving opening; the end-cap includes at least one retaining lip extending radially therefrom; and the slide-lock cassette includes an opening receiving a portion of the frame defining the end-cap receiving opening, and at least one retaining lip extending into the opening; wherein, in the second position of the slide-lock cassette, the at least one retaining lip of the slide-lock cassette is positioned in the end-cap receiving opening so as to oppose the at least one retaining lip of the end-cap to thereby capture the end-cap against removal from the frame.

7. The vehicle door handle assembly of claim 1, wherein, in the second position of the slide-lock cassette, the handle leg is connected to engagement flanges provided on the bellcrank.

8. The vehicle door handle assembly of claim 1, wherein further the slide-lock cassette supports an inertia lock.

9. A method of installing a vehicle door handle assembly, comprising the steps of:

providing a door handle having opposite first and second ends, the first end including a handle leg connectable to a bellcrank;

providing a door handle end-cap;

providing a slide-lock cassette supporting the bellcrank;

providing a frame for mounting the door handle and the door handle end-cap, the frame securable to a vehicle door, and the frame defining an opening receiving the slide-lock cassette therein, the opening dimensioned to permit sliding movement of the slide-lock cassette therein between a first position, in which the handle leg is not connected to the bellcrank and the door handle end-cap is not secured in place relative to the frame, and a second position, in which the handle leg is connected to the bellcrank and the door handle end-cap is captured by the slide-lock cassette against removal from the frame;

inserting the slide-lock cassette in the opening defined in the frame;

mounting the door handle and end-cap on the frame; and applying force to the slide-lock cassette to slidingly move the slide-lock cassette from the first position to the second position, thereby connecting the handle leg to the bellcrank and the capturing the door handle end-cap by the slide-lock cassette against removal from the frame.

10. The method of claim 9, further comprising a mounting feature engageable with the slide-lock cassette and selectively adjustable to effect sliding movement of the slide-lock cassette relative to the frame between the first and second positions, and wherein the step of slidingly moving the slide-lock cassette comprises selectively adjusting the mounting feature.

11. The method of claim 10, wherein the mounting feature comprises a screw disposed in an opening in the frame for rotational movement relative thereto, the screw threadingly engaged with the slide-lock cassette so that rotational movement of the screw moves the slide-lock cassette relative to the screw, thereby effecting sliding movement of the slide-lock cassette relative to the frame between the first and second positions.

12. The method of claim 9, wherein the frame includes one or more projections extending into the slide-lock cassette-receiving opening, the one or more projections confronting one or more surfaces of the slide-lock cassette to slidably capture the slide-lock cassette within the slide-lock cassette-receiving opening.

13. The method of claim 12, wherein the frame defines an end-cap receiving opening, and the one or more projections include at least one shelf portion defined about the perimeter of the slide-lock cassette-receiving opening, and at least one tab extending away from the end-cap receiving opening.

14. The method of claim 9, wherein further: the frame defines an end-cap receiving opening; the end-cap includes at least one retaining lip extending radially therefrom; and the slide-lock cassette includes an opening receiving a portion of the frame defining the end-cap receiving opening, and at least one retaining lip extending into the opening; wherein, in the second position of the slide-lock cassette, the at least one retaining lip of the slide-lock cassette is positioned in the end-cap receiving opening so as to oppose the at least one retaining lip of the end-cap to thereby capture the end-cap against removal from the frame.

15. The method of claim 9, wherein, in the second position of the slide-lock cassette, the handle leg is connected to engagement flanges provided on the bellcrank.

16. The method of claim 9, wherein further the slide-lock cassette supports an inertia lock.

17. In a vehicle door handle assembly including a door handle having opposite first and second ends, the first end including a handle leg, and a door handle end-cap, a sub-assembly comprising:

(a) a slide-lock cassette supporting a bellcrank connectable to the handle leg of the handle; and (b) a frame securable to a vehicle door, the frame mounting the door handle and the door handle end-cap, and the frame defining an opening receiving the slide-lock cassette therein, the opening dimensioned to permit sliding movement of the slide-lock cassette therein;

wherein the slide-lock cassette is, by the application of force thereto, slidingly moveable relative to the frame between a first position, in which the handle leg is not connected to the bellcrank and the door handle end cap is not secured in place relative to the frame, and a second position, in which the handle leg is connected to the bellcrank and the door handle end-cap is captured by the slide-lock cassette against removal from the frame.

18. The sub-assembly of claim 17, further comprising a mounting feature engageable with the slide-lock cassette and selectively adjustable to effect the sliding movement of the slide-lock cassette relative to the frame.

19. The sub-assembly of claim 18, wherein the mounting feature comprises a screw disposed in an opening in the frame for rotational movement relative thereto, the screw threadingly engaged with the slide-lock cassette so that rotational movement of the screw moves the slide-lock cassette relative to the screw, thereby effecting the sliding movement of the slide-lock cassette relative to the frame.

20. The sub-assembly of claim 17, wherein the frame includes one or more projections extending into the slide-lock cassette-receiving opening, the one or more projections confronting one or more surfaces of the slide-lock cassette to slidably capture the slide-lock cassette within the slide-lock cassette-receiving opening.

21. The sub-assembly of claim 20, wherein the frame defines an end-cap receiving opening, and the one or more projections include at least one shelf portion defined about the perimeter of the slide-lock cassette-receiving opening, and at least one tab extending away from the end-cap receiving opening.

22. The sub-assembly of claim 17, wherein the door handle end-cap of the vehicle door handle assembly includes at least one retaining lip extending radially therefrom, and wherein further: the frame defines an end-cap receiving opening; the slide-lock cassette includes an opening receiving a portion of the frame defining the end-cap receiving opening, and at least one retaining lip extending into the opening; and wherein, in the second position of the slide-lock cassette, the at least one retaining lip of the slide-lock cassette is positioned in the end-cap receiving opening so as to oppose the at least one retaining lip of the end-cap to thereby capture the end-cap against removal from the frame.

23. The sub-assembly of claim 17, wherein, in the second position of the slide-lock cassette, the handle leg is connected to engagement flanges provided on the bellcrank.

24. The sub-assembly of claim 17, wherein further the slide-lock cassette supports an inertia lock.

* * * * *